US010602866B2

(12) United States Patent
Gooden

(10) Patent No.: US 10,602,866 B2
(45) Date of Patent: Mar. 31, 2020

(54) MAILBOX FLAG HOLDER

(71) Applicant: Benny R. Gooden, Elizabethtown, NC (US)

(72) Inventor: Benny R. Gooden, Elizabethtown, NC (US)

( * ) Notice: Subject to any disclaimer, the term of this patent is extended or adjusted under 35 U.S.C. 154(b) by 9 days.

(21) Appl. No.: 15/669,071

(22) Filed: Aug. 4, 2017

(65) Prior Publication Data

US 2019/0038061 A1 Feb. 7, 2019

(51) Int. Cl.

| | |
|---|---|
| ***A47B 96/06*** | (2006.01) |
| ***A47G 29/122*** | (2006.01) |
| ***A47G 29/12*** | (2006.01) |
| ***G09F 17/00*** | (2006.01) |

(52) U.S. Cl.

CPC ..... *A47G 29/122* (2013.01); *A47G 29/1209* (2013.01); *G09F 17/00* (2013.01)

(58) Field of Classification Search

CPC .... A47G 29/122; A47G 29/1209; G09F 17/00
USPC .. 248/213.2, 229.16, 231.81, 539, 915, 536; 232/33, 38, 39

See application file for complete search history.

(56) References Cited

U.S. PATENT DOCUMENTS 1,648,220 A * 11/1927 Gerow ..... E04H 12/32 248/230.9
3,468,428 A * 9/1969 Reibold ..... A47F 5/06 108/103
3,762,632 A * 10/1973 Voegeli ..... A47G 29/1203 232/33
4,372,481 A * 2/1983 Benson ..... A47G 29/121 232/34
5,106,016 A * 4/1992 Beckmann ..... A47G 29/1209 232/17
5,277,779 A * 1/1994 Henshaw ..... C23C 14/3407 204/192.12
5,377,944 A * 1/1995 Getsinger ..... G09F 17/00 248/218.4
6,663,069 B1 * 12/2003 Norberg ..... F21V 21/08 24/339
7,611,043 B2 * 11/2009 Black ..... A47G 29/1216 232/38
8,919,638 B2 * 12/2014 McCormick ..... A47G 29/1209 232/33
8,939,353 B1 * 1/2015 Blocker ..... A47G 29/121 232/34
9,378,666 B1 * 6/2016 Woodruff ..... E04H 12/32
2003/0098403 A1 * 5/2003 Fox ..... G09F 17/00 248/538
2010/0058972 A1 * 3/2010 Kinvi ..... G09F 17/00 116/173

* cited by examiner

*Primary Examiner* — Gwendolyn W Baxter
(74) *Attorney, Agent, or Firm* — Coats & Bennett PLLC

(57) ABSTRACT

Disclosed is a mailbox flag holder configured to be inserted over a conventional mailbox. The flag holder is particularly constructed to frictionally engage a mailbox such that the flag holder is securely held on the mailbox. Structurally, the flag holder is of a U-shape construction that includes a pair of legs and a base interconnecting the legs. The legs are slightly spreadable to accommodate the mailbox and once inserted on the mailbox, the legs tend to pull inwardly and grip the mailbox.

9 Claims, 3 Drawing Sheets

MAILBOX FLAG HOLDER

FIELD OF THE INVENTION

The present invention relates to flag holders and more particularly to a flag holder that is adapted and configured to mount to a mailbox.

BACKGROUND OF THE INVENTION

Flags symbolize various things to various people. Many people are proud to fly Old Glory for any number of reasons, including a passionate desire to show their patriotism. Many other people enjoy flying collegiate flags and flags that are associated with many organizations and associations throughout the country. For sure, there are many different flags that are important symbols for many people. However, it is not always easy to find a convenient place for flying a flag. We are aware of flag holders that can be secured to vehicles and we are aware of flag holders that one sees attached to the front porches of houses for flying large flags. However, smaller flags are very popular today But it is difficult to find appropriate places where these flags can be flown in such a way that they are visible to many.

SUMMARY OF THE INVENTION

The present invention relates to a flag holder specifically configured to mount to a conventional mailbox.

In one particular design, the flag holder assumes a generally U-shaped construction. The flag holder is configured to slip over the mailbox and to extend over and around the top and sidewalls of the mailbox. The structure of the flag holder is designed to frictionally engage and grip the mailbox so that the flag holder is securely held and stationed on the mailbox. The flag holder, as described herein, is designed to support one or a plurality of flags.

Other objects and advantages of the present invention will become apparent and obvious from a study of the following description and the accompanying drawings which are merely illustrative of such invention.

DESCRIPTION OF THE PREFERRED EMBODIMENT

Figure 1:
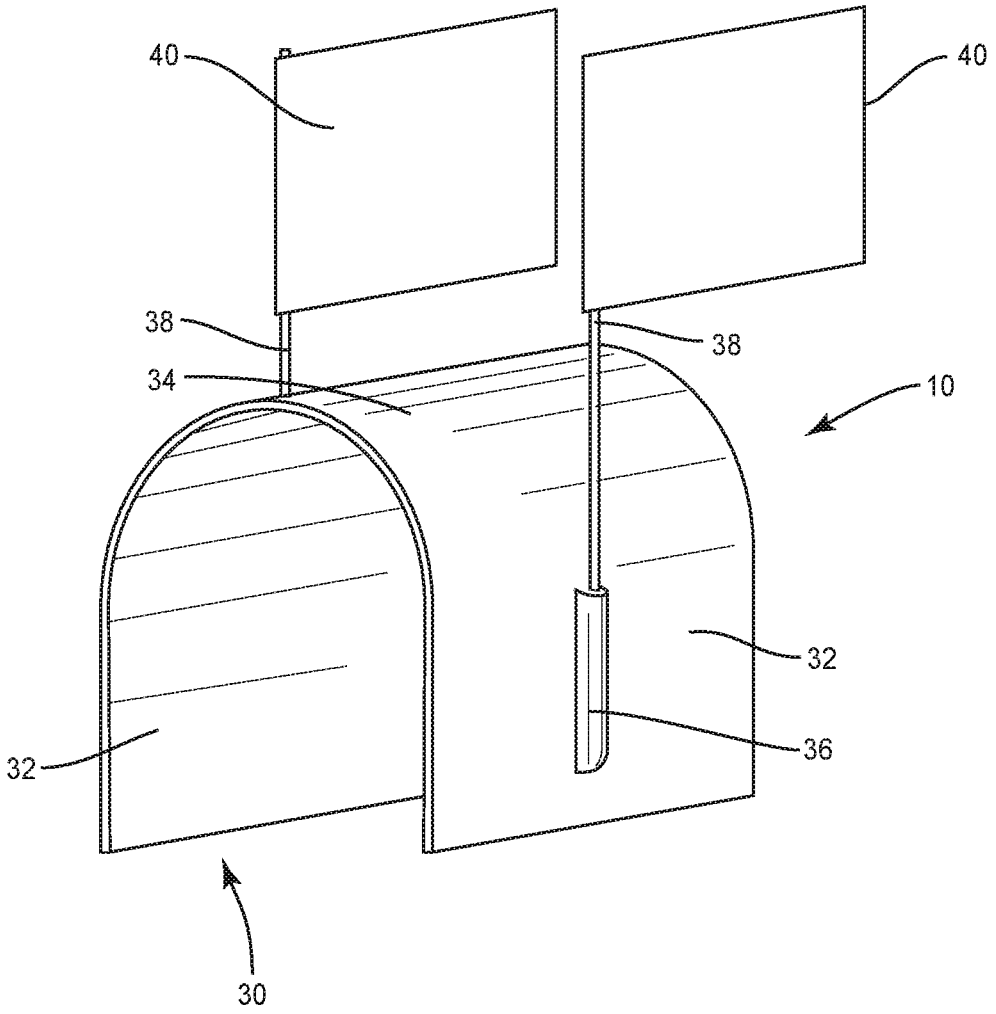
FIG. 1 is a perspective view of the flag holder of the present invention.
Figure 2:
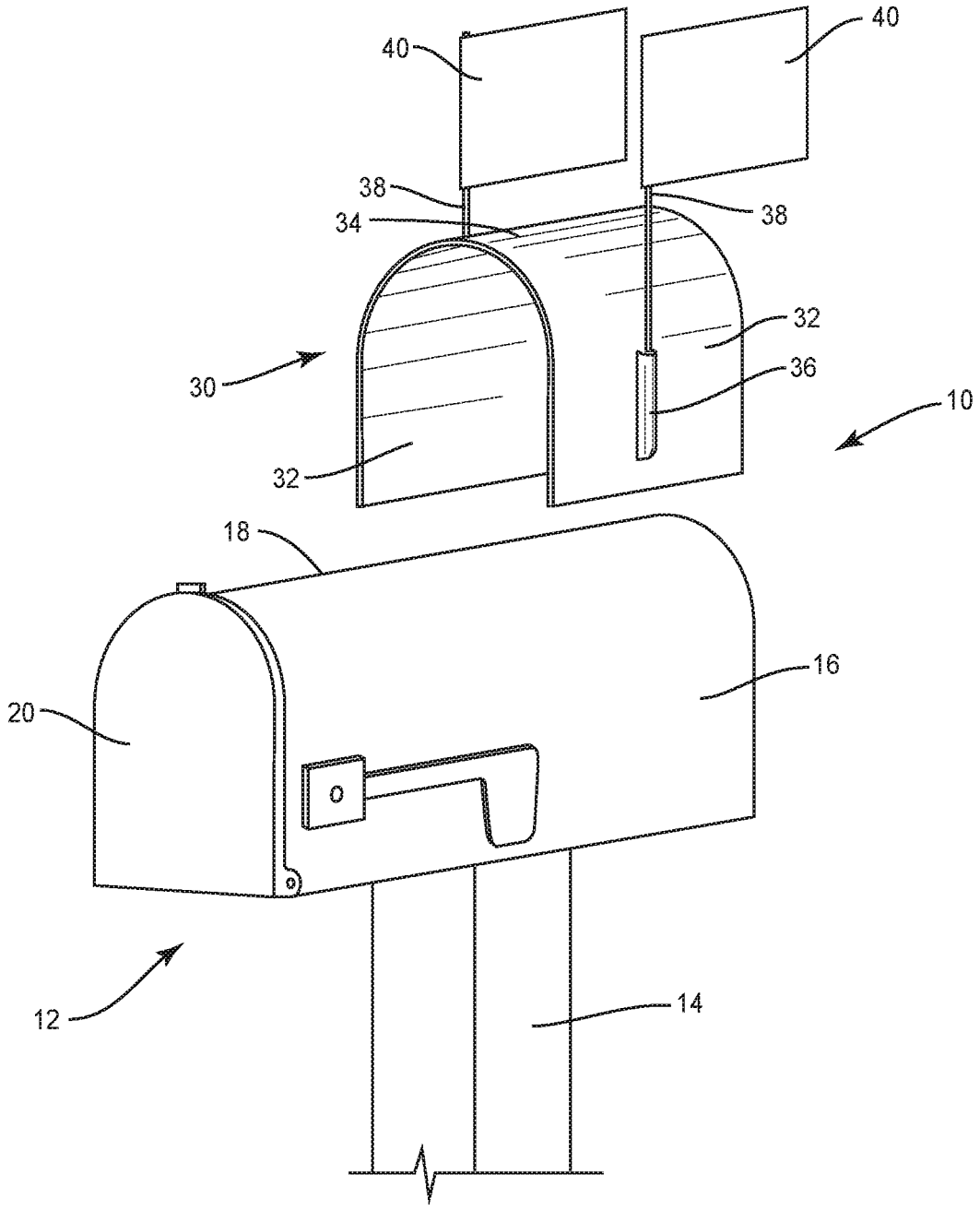
FIG. 2 is a perspective view of the flag holder of the present invention showing the flag holder disposed over a mailbox prior to the flag holder being inserted onto the mailbox.
Figure 3:
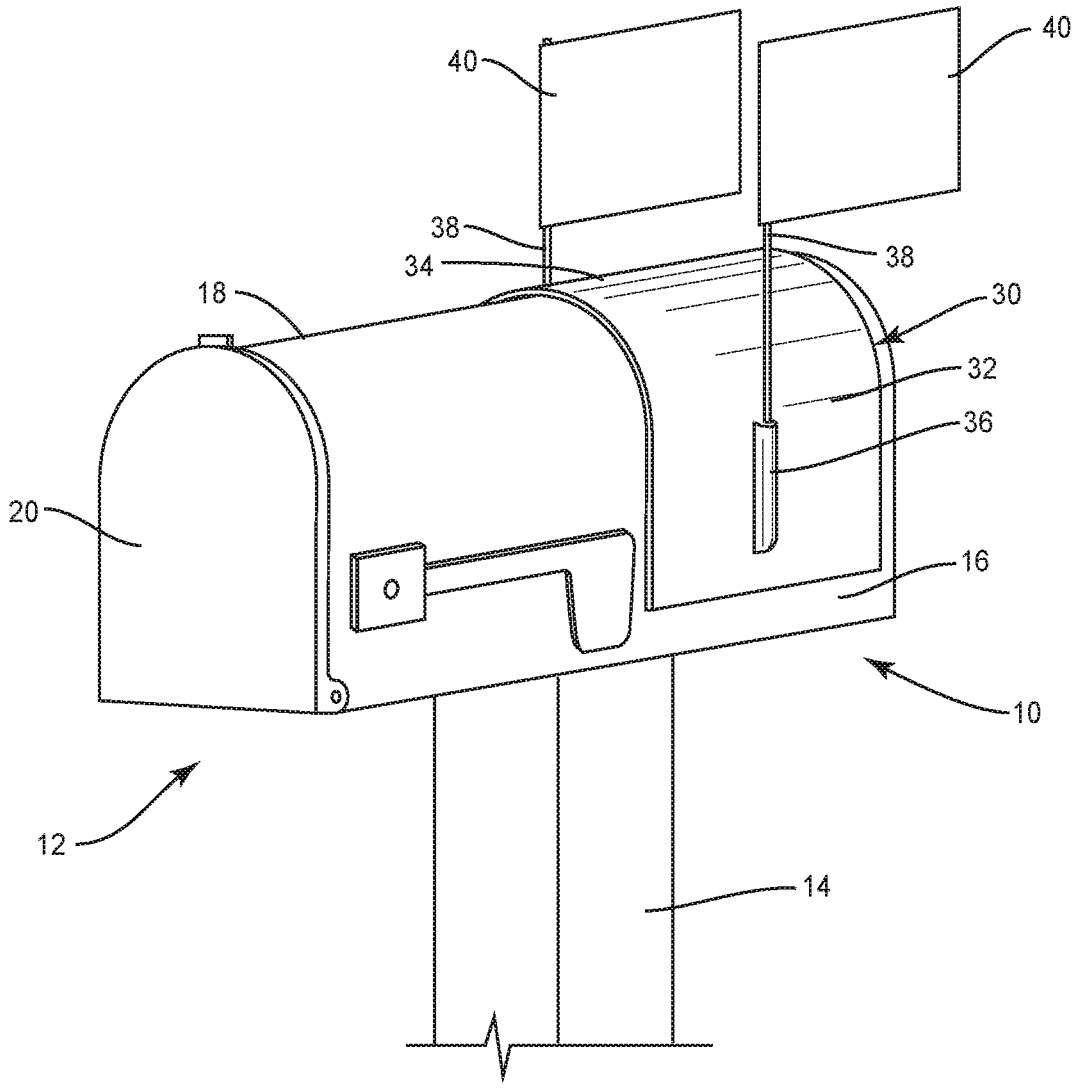
FIG. 3 is a perspective view showing the flag holder on the mailbox.

The present invention relates to a mailbox flag holder. With particular reference to FIGS. 1-3, the flag holder of the present invention is indicated generally by the numeral 10. As will be discussed below, the flag holder 10 is designed to be inserted onto a conventional mailbox 12 and to provide for accommodating one or more flags.

Before discussing the flag holder 10, reference is made to FIGS. 2 and 3 which show a conventional mailbox 12. Mailbox 12, as shown in FIGS. 2 and 3, is a conventional mailbox that includes a bottom and a back which are not expressly shown in FIGS. 2 and 3. Further, the mailbox 12 includes a pair of sidewalls 16 and a curved top 18 that extends between the sidewalls. Further, the mailbox 10 in conventional fashion includes a front door 20 that is normally closed but openable to enable one to gain access to an internal area in the mailbox that holds mail.

Now turning to the flag holder 10, it is seen from FIGS. 2 and 3 that the flag holder is designed to easily and conveniently mount to the mailbox 10. In particular, the flag holder 10 is of a simple construction and is configured to be pushed down onto and around portions of the mailbox 12 in such a fashion that the flag holder grips the mailbox and is held securely in place on the mailbox. While in some cases fasteners may be used to physically connect the flag holder 10 to the mailbox 12, in the present design fasteners are not required. The physical structure of the flag holder 10 itself is designed to frictionally engage in such a fashion that the flag holder is secured to the mailbox 10.

Viewing flag holder 10 in more detail, the flag holder comprises what is termed a saddle mount. The saddle mount is indicated generally in the drawings by the numeral 30. The saddle mount, as viewed in FIGS. 2 and 3, includes a generally inverted U-shape structure that is configured and dimensioned to engage and surround portions of the sidewalls 16 and top 18 of the mailbox. More particularly, the saddle mount 30 includes a pair of opposed legs 32 and a curved base 34 that extends between the opposed legs 32.

Formed in the legs 32 is a sleeve 36. The sleeve 36 is elongated and includes an elongated opening that is designed and configured to receive a flag support 38. Note that the sleeve 36 is closed at the bottom but opened at the top that enables the flag support 38 to be inserted downwardly into the sleeve. The sleeve 36 is of a sufficient height that the flag 40, as well as the flag support 38, is securely held by the flag holder.

Flag holder 10 can be constructed of plastic, metal, wood or any other suitable materials. In one embodiment, it is contemplated that the flag holder 10 would be constructed of a molded plastic. In one embodiment, the legs 32 of the flag holder 10 are at least slightly flexible and are dimensioned such that when the flag holder is inserted downwardly over the mailbox that the legs 32 will slightly spread to accommodate the mailbox. This results in the legs 32 of the flag holder tending to pull inwardly and securely grip the mailbox 12 and particularly the sidewalls 16 thereof. This securely stations the flag holder 10 on the mailbox 12 such that it will withstand wind, rain and other weather conditions and will not inadvertently fall off of the mailbox. This form of resilient gripping action can be embodied in a plastic, metal or wood construction, for example.

As seen in the drawings and as appreciated from the foregoing discussion, the flag holder 10 of the present invention is of a simple construction and easy and convenient to employ and use. The size and length of the flag holder can be varied. It can be designed to support or hold one flag or many flags. And it is appreciated that the flag holder design lends itself to the flags being interchangeable. This allows an individual to change and replace the one or more flags from time-to-time. Changing the flags is a simple matter as the flags can be lifted from the sleeves 36 and new or additional flags can be inserted into the sleeves.

In the end, the flag holder 10 can be cost effectively manufactured. The mailbox 12 serves as a ready support for the flag holder 10. That is, since the flag holder is configured to be mounted on an existing mailbox, there is no need to install a flag pole or any other supporting structure.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A mailbox flag holder configured to straddle a mailbox and to secure one or more flags about the mailbox, the mailbox flag holder comprising: a straddle connector configured to extend around opposite sides and a top portion of the mailbox and configured to frictionally engage the mailbox so as to secure the straddle connector to the mailbox; the straddle connector assuming a generally U-shaped configuration and including opposite legs and a curved base integral with the two legs; wherein the legs of the straddle connector are at least slightly flexible and configured to at least slightly spread when inserted onto the mailbox and configured to grip the mailbox when the legs and base engage the mailbox; and one or more elongated sleeves formed in one or more of the legs of the straddle connector and wherein each sleeve is configured to receive a flag support.

2. The mailbox flag holder of claim 1 wherein the straddle connector is constructed of molded plastic.

3. The mailbox flag holder of claim 1 wherein each said sleeve is integrally formed in a respective leg of the straddle connector.

4. The mailbox flag holder of claim 1 wherein each said sleeve is integrally formed in a respective leg of the straddle connector and wherein each leg of the straddle connector includes opposed edges and wherein the integrally formed sleeve extends parallel to the opposed edges of the leg.

5. The mailbox holder of claim 1 wherein the mailbox includes a length, a transverse width, a top, and a pair of sides and a signaling flag secured to one side of the mailbox for signaling that the mailbox includes mail for pickup; and wherein the straddle connector includes a length substantially less than the length of the mailbox and wherein the straddle connector is configured to overlie only a portion of the mailbox and configured to assume a position on the mailbox spaced rearwardly of the signaling flag so as to not overlie or interfere with the signaling flag.

6. The mailbox holder of claim 5 wherein the one or more elongated sleeves are integrally formed in one or more of the legs of the straddle connector and wherein the s straddle connector, including the elongated sleeves, is formed by molded plastic.

7. A combination mailbox and flag holder comprising: a mailbox having a front door, a pair of sidewalls and a curved top extending between the curved sidewalls; a flag holder configured to mount on the mailbox and to extend around and engage the sidewalls and curved top of the mailbox; the flag holder including a straddle connector configured to extend around the opposite sidewalls and the curved top of the mailbox and wherein the straddle connector is configured to frictionally engage the sidewalls and curved top of the mailbox and to effectively clamp onto the mailbox; the straddle connector assuming a generally U-shape and including a pair of opposed legs and a curved base integral with the legs; wherein the legs are at least slightly flexible and configured to slightly spread in response to the saddle connector being inserted onto the mailbox and wherein the legs are configured to engage and grip the sidewalls of the mailbox so as to secure the straddle connector to the mailbox; and one or more elongated sleeves formed in one or more of the legs of the straddle connector; and wherein each sleeve is configured to receive a flag pole or a flag support that includes a flag secured to a portion thereof.

8. The combination mailbox and flag holder of claim 7 wherein the straddle connector is constructed of plastic.

9. A mailbox flag holder configured to straddle a rear portion of an elongated mailbox having a length, a transverse width, a top, a pair of sides, and a signaling flag secured on one side of the mailbox for signaling that the mailbox includes mail for pickup, and wherein the flag holder is configured to secure one or more flags about the mailbox, the mailbox holder comprising: a straddle connector configured to extend around the top and sides of the mailbox; the straddle connector configured such that when the straddle connector is placed on the mailbox, the straddle connector assumes a generally inverted U-shape and includes a curved top portion and a pair of sides that extend downwardly adjacent the sides of the mailbox; wherein the straddle connector includes a length substantially less than the length of the mailbox and wherein the straddle connector in configured to overlie only a portion of the mailbox and configured to assume a position on the mailbox spaced rearwardly of the signaling flag so as to not overlie or interfere with the signaling flag; one or more elongated sleeves formed in the one or more sides of the straddle connector with each sleeve configured to receive a flag support; and wherein each sleeve is configured to extend vertically along one side of the straddle connector when the straddle connector straddles the mailbox.

* * * * *